US011326401B2

(12) United States Patent
Noui-Mehidi et al.

(10) Patent No.: US 11,326,401 B2
(45) Date of Patent: May 10, 2022

(54) TOOL AND METHOD FOR FORMING A CAVERN FOR HYDROCARBON PRODUCTION

(71) Applicant: SAUDI ARABIAN OIL COMPANY, Dhahran (SA)

(72) Inventors: Mohamed Nabil Noui-Mehidi, Dhahran (SA); Khalid M. Ruwaili, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/822,539

(22) Filed: Mar. 18, 2020

(65) Prior Publication Data

US 2021/0293092 A1 Sep. 23, 2021

(51) Int. Cl.

| | |
|---|---|
| ***E21B 7/30*** | (2006.01) |
| ***E21B 43/12*** | (2006.01) |
| ***E21B 43/20*** | (2006.01) |
| ***E21B 47/00*** | (2012.01) |

(52) U.S. Cl.

CPC ..... *E21B 7/30* (2013.01); *E21B 43/128* (2013.01); *E21B 43/20* (2013.01); *E21B 47/00* (2013.01)

(58) Field of Classification Search

CPC ..... E21B 43/26; E21B 43/27; E21B 43/28; E21B 43/20; E21B 43/128; E21B 41/0078; E21B 41/00; E21B 7/30

See application file for complete search history.

(56) References Cited

U.S. PATENT DOCUMENTS

| | | | | |
|---|---|---|---|---|
| 2,994,200 | A | 8/1961 | Carpenter | |
| 3,438,203 | A | 4/1969 | Lamb et al. | |
| 3,741,306 | A | 6/1973 | Papadopoulos et al. | |
| 3,759,328 | A * | 9/1973 | Ueber | E21B 43/24 166/272.1 |
| 3,858,654 | A * | 1/1975 | Walker | E21B 43/281 166/272.6 |
| 5,129,759 | A | 7/1992 | Bishop | |
| 5,246,273 | A | 9/1993 | Rosar | |
| 2010/0193193 | A1 | 8/2010 | Wagg et al. | |

(Continued)

FOREIGN PATENT DOCUMENTS

| | | | |
|---|---|---|---|
| CN | 85202728 | U | 10/1986 |
| CN | 109838279 | A | 6/2019 |

(Continued)

OTHER PUBLICATIONS

International Search Report and Written Opinion issued in corresponding International Application No. PCT/US2020/028610, dated Dec. 7, 2020 (15 pages).

*Primary Examiner* — Taras P Bemko
*Assistant Examiner* — Yanick A Akaragwe
(74) *Attorney, Agent, or Firm* — Osha Bergman Watanabe & Burton LLP

(57) ABSTRACT

A tool for forming a cavern for hydrocarbon production includes a housing having a cavity. A rotary actuator is disposed in the cavity. A fluid dispenser has an internal chamber to receive an aqueous solution and one or more nozzles to dispense the aqueous solution. The fluid dispenser is coupled to the rotary actuator and is rotatable about a tool axis by the rotary actuator. One or more proximity sensors are disposed at a perimeter of the housing to measure a distance relative to the tool.

11 Claims, 11 Drawing Sheets

(56) References Cited

U.S. PATENT DOCUMENTS

| | | | | |
|---|---|---|---|---|
| 2011/0226531 | A1* | 9/2011 | Jones | E21B 47/085<br>175/50 |
| 2014/0338921 | A1 | 11/2014 | Barry et al. | |
| 2020/0308945 | A1* | 10/2020 | Surjaatmadja | E21B 43/26 |

FOREIGN PATENT DOCUMENTS

| | | | |
|---|---|---|---|
| DE | 202018001073 | U | 3/2018 |
| JP | H0762967 | A | 3/1995 |
| KR | 20120120645 | A | 11/2012 |
| RU | 2543005 | C1 | 2/2015 |
| WO | 2010/150010 | A2 | 12/2010 |
| WO | 2017/009645 | A1 | 1/2017 |
| WO | 2017/119877 | A1 | 7/2017 |

* cited by examiner

TOOL AND METHOD FOR FORMING A CAVERN FOR HYDROCARBON PRODUCTION

FIELD

The disclosure relates generally to production of fluid from subterranean reservoirs.

BACKGROUND

Fluids are typically produced from a reservoir in a subterranean formation by drilling a wellbore into the subterranean formation, establishing a flow path between the reservoir and the wellbore, and conveying the fluids from the reservoir to the surface through the wellbore. Typically, a production tubing is disposed in the wellbore to carry the fluids to the surface. The production tubing may include a pump to assist in lifting the fluids up the wellbore. Fluids produced from a hydrocarbon reservoir may include natural gas, oil, and water. One common challenge in producing fluids from a hydrocarbon reservoir through a wellbore is the ability to continuously lift clear volumes of oil or gas (i.e., volumes in which water is not mixed with the oil or gas) to the surface relatively inexpensively and without disturbing the fluid system.

SUMMARY

A method for hydrocarbon production includes forming a wellbore in a subterranean formation, disposing a tool comprising a fluid dispenser and at least one proximity sensor in the wellbore, positioning the fluid dispenser at an initial depth in an end section of the wellbore, providing an acidic aqueous solution to the fluid dispenser, and forming a cavern of a select height in the end section of the wellbore with the tool. The cavern is formed by rotating the fluid dispenser to distribute the acidic aqueous solution to a portion of the subterranean formation surrounding the fluid dispenser, wherein the acidic aqueous solution dissolves a rock material in the portion of the subterranean formation; measuring a distance between the tool and the portion of the subterranean formation surrounding the fluid dispenser using the at least one proximity sensor; and adjusting a position of the fluid dispenser to another depth in the end section of the wellbore if the distance measured is at or above a predetermined threshold. The tool may be lowered into the wellbore on an end of a coiled tubing. The acidic aqueous solution may be provided to the fluid dispenser through the coiled tubing. The wellbore may be formed in a carbonate formation comprising a hydrocarbon reservoir. The initial select depth of the fluid dispenser may be proximate a bottom of the wellbore. The position of the fluid dispenser may be adjusted to another select depth in the end section of the wellbore by raising the fluid dispenser to the another select depth. The cavern formed may have a cylindrical side wall and a dome shaped top wall. The tool may be removed from the wellbore after forming the cavern, and the cavern may be filled with brine. A production tubing may be disposed in the wellbore. The production tubing may be in communication with the cavern. The brine from the cavern may be withdrawn through the production tubing. Fluids from the subterranean formation may flow into the cavern as the brine is withdrawn from the cavern. The fluids from the subterranean formation may be stratified by gravity inside the cavern. The method may include withdrawing the stratified fluids from the cavern through the production tubing. The brine and stratified fluids may be withdrawn from the cavern through the production tubing by operating a pump disposed in the production tubing.

A tool for forming a cavern for hydrocarbon production includes a housing having a cavity, a rotary actuator disposed in the cavity, and a fluid dispenser having an internal chamber to receive an aqueous solution and at least one nozzle to dispense the aqueous solution. The fluid dispenser is coupled to the rotary actuator and rotatable about a tool axis by the rotary actuator. The tool includes at least one proximity sensor disposed at a perimeter of the housing to measure a distance relative to the tool. The at least one proximity sensor may be an ultrasonic sensor. The sensing direction of the at least one proximity sensor may be perpendicular to the tool axis. The sensing direction of the at least one proximity sensor may be inclined to the tool axis. The fluid dispenser may include a plurality of nozzles to dispense the aqueous solution. At least one of the plurality of nozzles may have a straight shape, and at least another one of the plurality of nozzles may have an angled shape. The tool may include a support tube that is coupled to the housing. The support tube may have a bore that is fluidly connected to the internal chamber.

A system for forming a cavern includes a wellbore traversing a subterranean formation, a coiled tubing supported by a reel, and a tool for forming a cavern disposed in the wellbore on an end of the coiled tubing. The tool includes a housing having a cavity, a rotary actuator disposed in the cavity, and a fluid dispenser fluidly connected to the coiled tubing. The fluid dispenser has an internal chamber to receive fluid from the coiled tubing and at least one nozzle to dispense the fluid. The fluid dispenser is coupled to the rotary actuator and rotatable about the tool axis by the rotary actuator. The tool includes a fluid path between the internal chamber and the coiled tubing. The tool includes at least one proximity sensor disposed at a perimeter of the housing to measure a distance between the subterranean formation and the tool. The system may include a tank containing an acidic aqueous solution. The system may include a pump to transfer the acidic aqueous solution from the tank to the coiled tubing.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
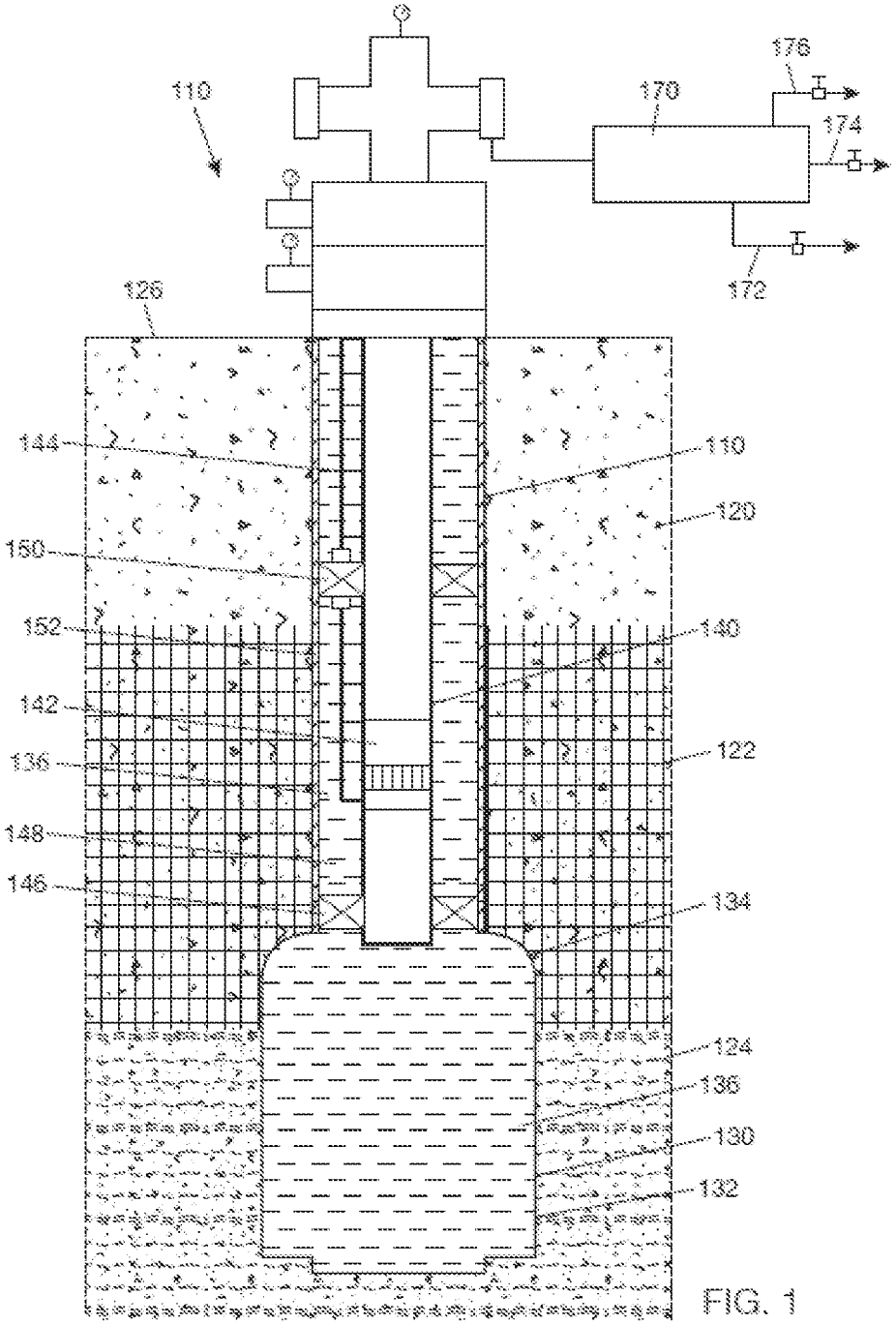
FIG. 1 is a schematic diagram of a system including a cavern for producing hydrocarbons from a reservoir according to one implementation.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, well known features or processes associated with the hydrocarbon production systems have not been shown or described in detail to avoid unnecessarily obscuring descriptions of the implementations and embodiments. For the sake of continuity, and in the interest of conciseness, same or similar reference characters may be used for same or similar objects in multiple figures.

FIG. 1 shows a system 100 for producing hydrocarbons according to one illustrative implementation. For illustration purposes, subterranean formations 120, 122, 124 are shown below a surface 126. In general, there may be many layers of subterranean formations below surface 126. For illustration purposes, formations 120, 122, 124 may be carbonate formations. In one example, formation 124 is a target reservoir containing hydrocarbons to be produced. System 100 includes a cavern 130 formed in formations 122, 124. Thus, at least a portion of cavern 130 is disposed in the target reservoir (formation 124). Cavern 130 has a side wall 132 having a cylindrical shape and a top wall 134 having a dome shape. Top wall 134 is connected to wellbore 110, which is connected to the surface 126. Cavern 130 is in fluid communication with formation 124 and can receive reservoir fluids directly from formation 124. Cavern 130 may be initially filled with brine 136 to prevent cavern 130 from collapsing and to equalize pressure within cavern 130 with pressure in formation 124, thereby temporarily preventing influx of reservoir fluids into cavern 130.

System 100 includes a production tubing 140, which is disposed in wellbore 110. Production tubing 140 extends into cavern 130, thereby forming a flow conduit from cavern 130 to surface 126. Production tubing 140 may include an electrical submersible pump (ESP) 142, which may be powered by a cable 144 from surface 126. A packer 146 may be arranged to seal an annulus 148 between production tubing 140 and wellbore 110 from cavern 130. A packer 150 may be arranged in annulus 148 and above ESP 142. A casing 152 may be installed in wellbore 110, and annulus 148 may be formed between production tubing 140 and casing 152. Annulus 148 may be filled with brine 136. At surface 126, fluids from production tubing 140 may be received in a separator 170, which may then operate to separate the fluids into oil, water, and gas. The separated fluids may be diverted into respective flow lines 172, 174, 176.

Figure 2:
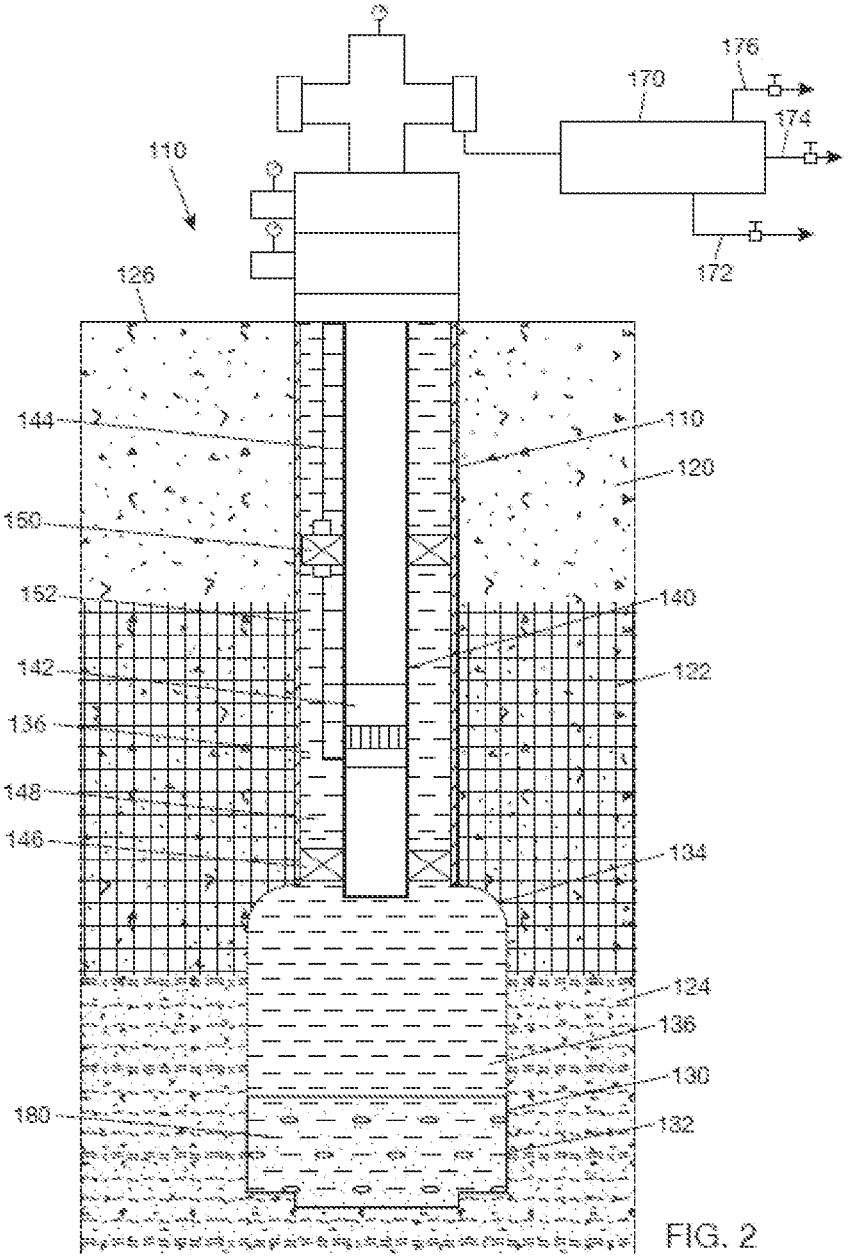
FIG. 2 shows influx of reservoir fluids into the cavern of FIG. 1.
Figure 3:
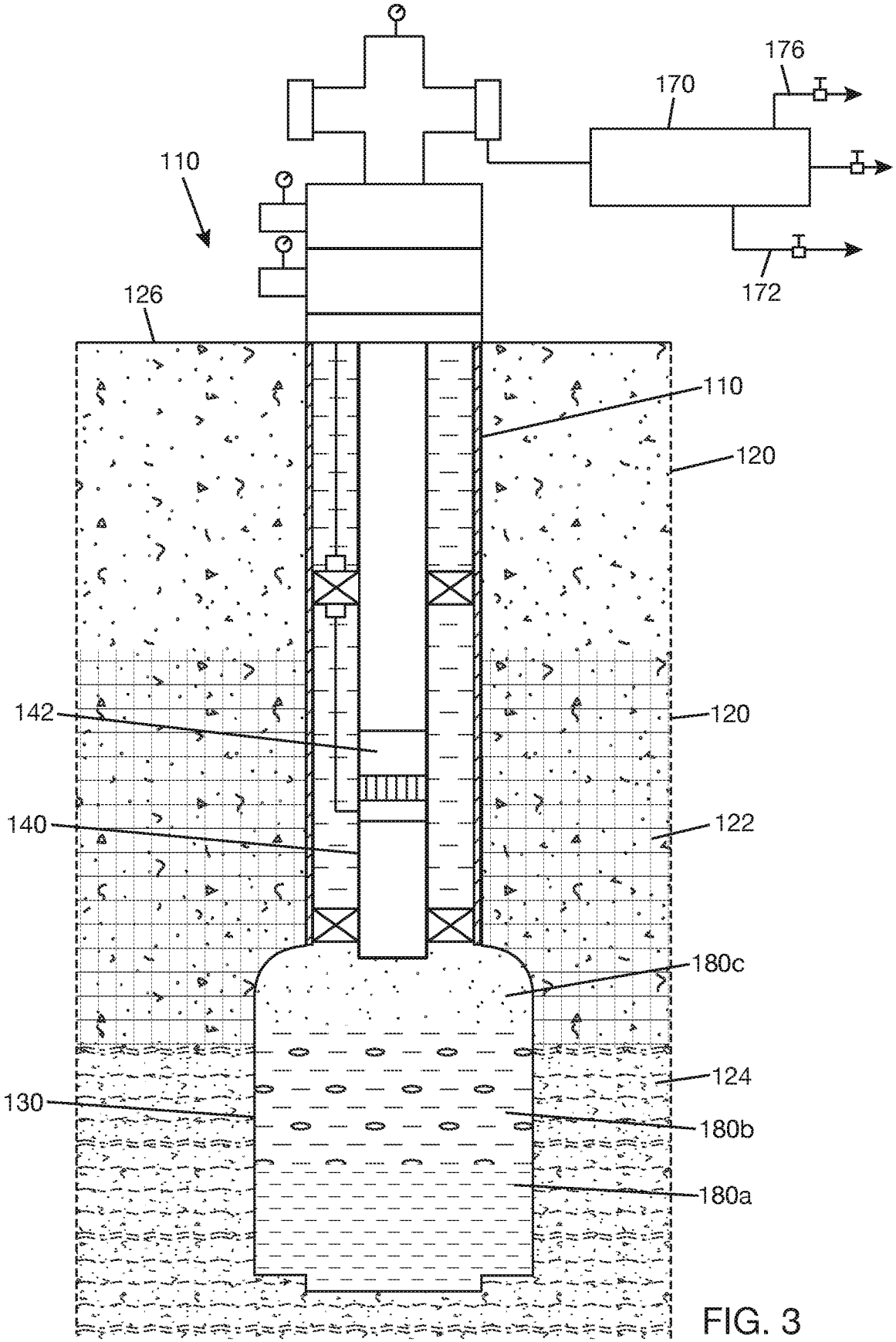
FIG. 3 shows stratification of reservoir fluids in the cavern of FIG. 1.

A method of producing hydrocarbons with system 100 may include operating ESP 142 to gradually withdraw brine 136 from cavern 130. As brine 136 is withdrawn from cavern 130, as shown in FIG. 2, reservoir fluids 180 from formation 124 will enter into cavern 130 and take up the volume left by withdrawn brine 136. Reservoir fluids 180 may include any combination of oil, gas, and water. Gravity will cause the heavier fluids (for example, water) to sink downward, while lighter fluids (for example, oil and gas) will float upwards. FIG. 3 shows stratification of fluids in cavern 130 due to gravity. For illustration purposes, fluid 180*a* forming a first layer at a deepest depth within cavern 130 may be water, fluid 180*b* forming a second layer on top of the first layer may be oil, and fluid 180*c* forming a third layer on top of the second layer may be gas. In this regard, cavern 130 functions as a downhole separator that is disposed between formation 124 (or target reservoir) and wellbore 110. Production tubing 140 will convey fluid from the upper volume of cavern 130 to separator 170 at surface 126. This is a continuous process where reservoir fluids 180 (in FIG. 2) enter cavern 130, are stratified by gravity (180*a*, 180*b*, 180*c* in FIG. 3), and are then produced to the surface according to their positions in cavern 130.

Figure 4:
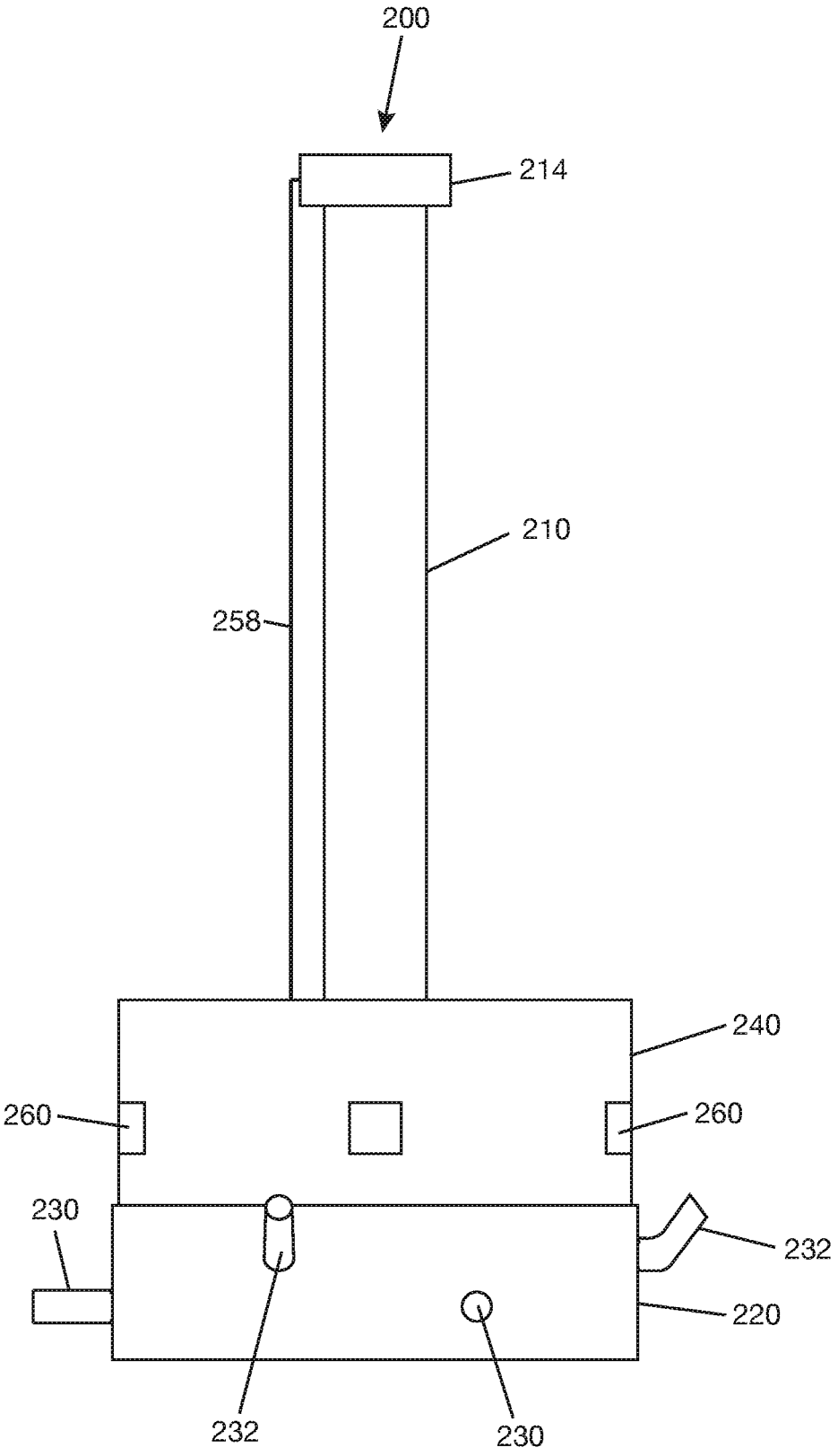
FIG. 4 is an elevation view of a tool for forming a cavern according to one implementation.
Figure 5:
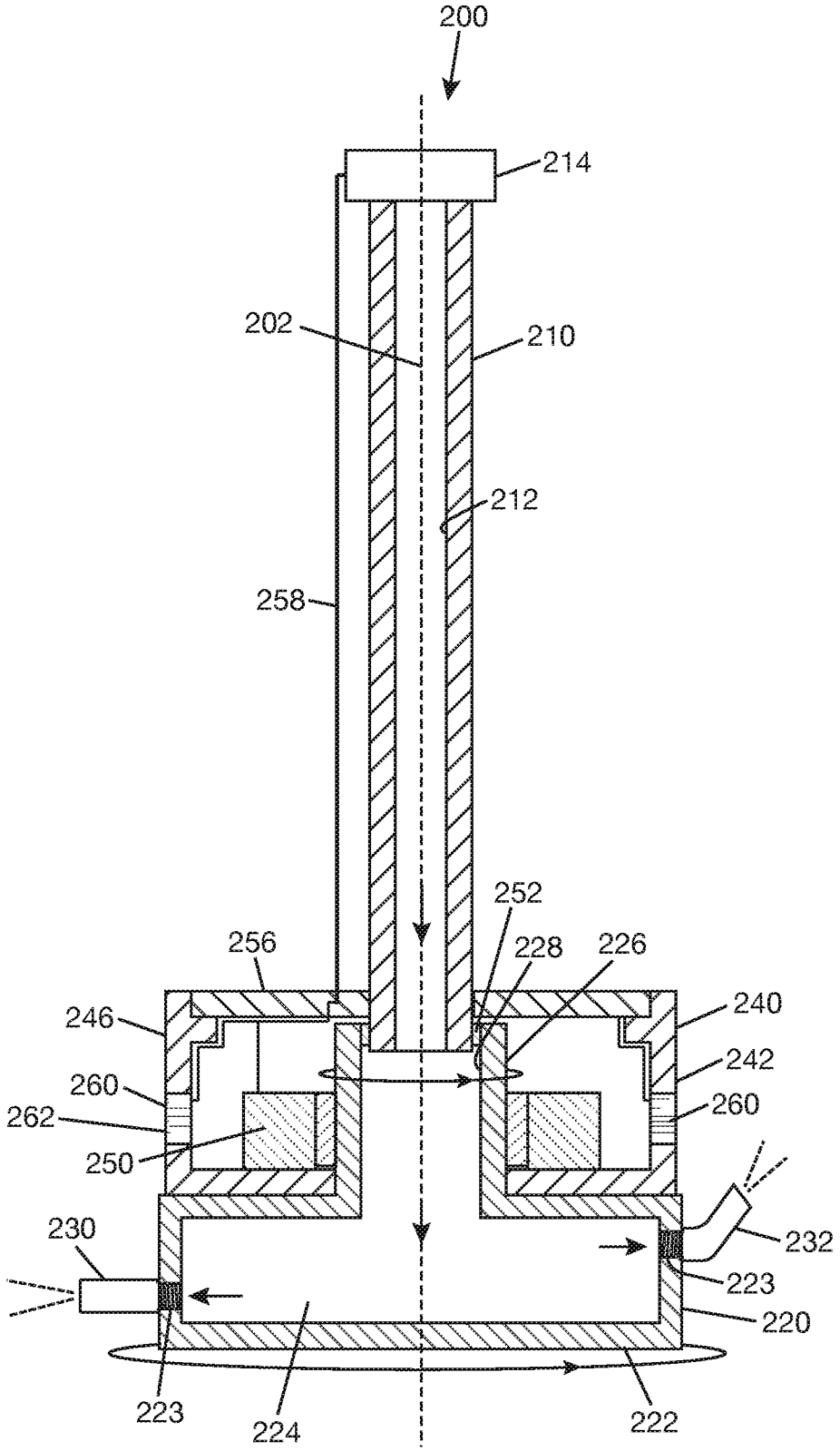
FIG. 5 is a vertical cross-section of the tool shown in FIG. 4 according to one implementation.

In one implementation, the method of producing hydrocarbons includes forming cavern 130 prior to producing fluids from cavern 130. FIGS. 4 and 5 show one implementation of a tool 200 for forming a cavern for hydrocarbon production. In FIG. 4, tool 200 includes a support tube 210, a fluid dispenser 220, and a rotary table 240. In FIG. 5, tool 200 has a tool axis 202. Support tube 210 has an axial axis that is aligned with tool axis 202. Support tube 210 has an axial bore 212 to convey fluid to fluid dispenser 220. A connector 214 is disposed at an end of support tube 210 for connection of tool 200 to a coiled tubing (not shown). Fluid dispenser 220 has a container 222 with an internal chamber 224 to receive fluid from support tube 210. Fluid dispenser 220 has a tube 226 that is connected at one end to container 222 and that extends upwardly from container 222. Tube 226 is axially aligned with support tube 210. Tube 226 has a bore 228 that is fluidly connected to internal chamber 224 and to bore 212 of support tube 210, allowing fluid from support tube 210 to flow into internal chamber 224. Container 222 has ports 223 in which nozzles 230, 232 are mounted. Nozzles 230, 232 have bores (not shown separately) that are fluidly connected to internal chamber 224. Nozzles 230, 232 are used to provide streams of fluid that are directed outwardly from fluid dispenser 220. Nozzles 230, 232 extend laterally from container 222. In the example shown in FIGS. 4 and 5, nozzles 230 are straight nozzles, and nozzles 232 are angled nozzles. A staggered arrangement of the nozzles is illustrated in FIGS. 4 and 5. In general, any number of nozzles, any combination of straight and angled nozzles, and any arrangement of nozzles can be selected to achieve a desired fluid distribution pattern from fluid dispenser 220.

Rotary table 240 includes a housing 242, which may be generally cylindrical in shape. Housing 242 has an axial axis that is aligned with tool axis 202. Within housing 242 is a rotary actuator 250. In one example, rotary actuator 250 is a hollow shaft motor. A hollow shaft motor has a hole running through the center of the motor. This permits tube 226 of fluid dispenser 220 to be assembled to the rotor of the motor. As the rotor rotates, tube 226 will be rotated, which will cause fluid dispenser 220 as a whole to be rotated. In the illustrated example of FIG. 5, tube 226 is shown as extending through rotary actuator 250, and support tube 210 is shown extending into tube 226. In one example, tube 226 rotates relative to support tube 210. A dynamic seal 252 may be disposed between tubes 226, 210 to allow relative motion between tubes 226, 210 while sealing between tubes 226, 210. Support tube 210 may be attached to a cover 256, which is attached to housing 242 so that support tube 210 is coupled to housing 242. In one example, rotary actuator 250 may be electrically powered. Electrical power to rotary actuator 250 may be provided through a cable 258 extending alongside support tube 210. Alternatively, rotary actuator 250 may be hydraulically powered. As an example, hydraulic power for rotary actuator 250 could come from the movement of fluid from tube 226 to internal chamber 224.

In one implementation, proximity sensors 260 are disposed at a perimeter 246 of housing 242, that is, sensing faces 262 of proximity sensors 260 are exposed at the perimeter of housing 242. Proximity sensors 260 may be used to measure a distance between housing 242 and a surrounding object, such as a surrounding formation. During use of tool 200, proximity sensors 260 can measure a parameter related to a radius of a cavern being formed by tool 200. The measurements made by proximity sensors 260 can be used to make decisions about when to move tool 200 to another depth in order to form another portion of the cavern. In one implementation, proximity sensors 260 are ultrasonic sensors. In one example, an ultrasonic sensor works by transmitting an ultrasonic pulse and receiving a reflection of the pulse. The distance to the object can be determined from the time difference between the transmitted pulse and reflected pulse. In some cases, cable 258 may provide electrical power to proximity sensors 260 (260'). Cable 258 may also serve as a medium for transmitting measurements from proximity sensors 260 to a control system at a surface location. The control system may include a processor that receives measurements from proximity sensors 260 and uses the measurements to determine whether to adjust the position of tool 200 during forming of a cavern with tool 200.

Figure 6:
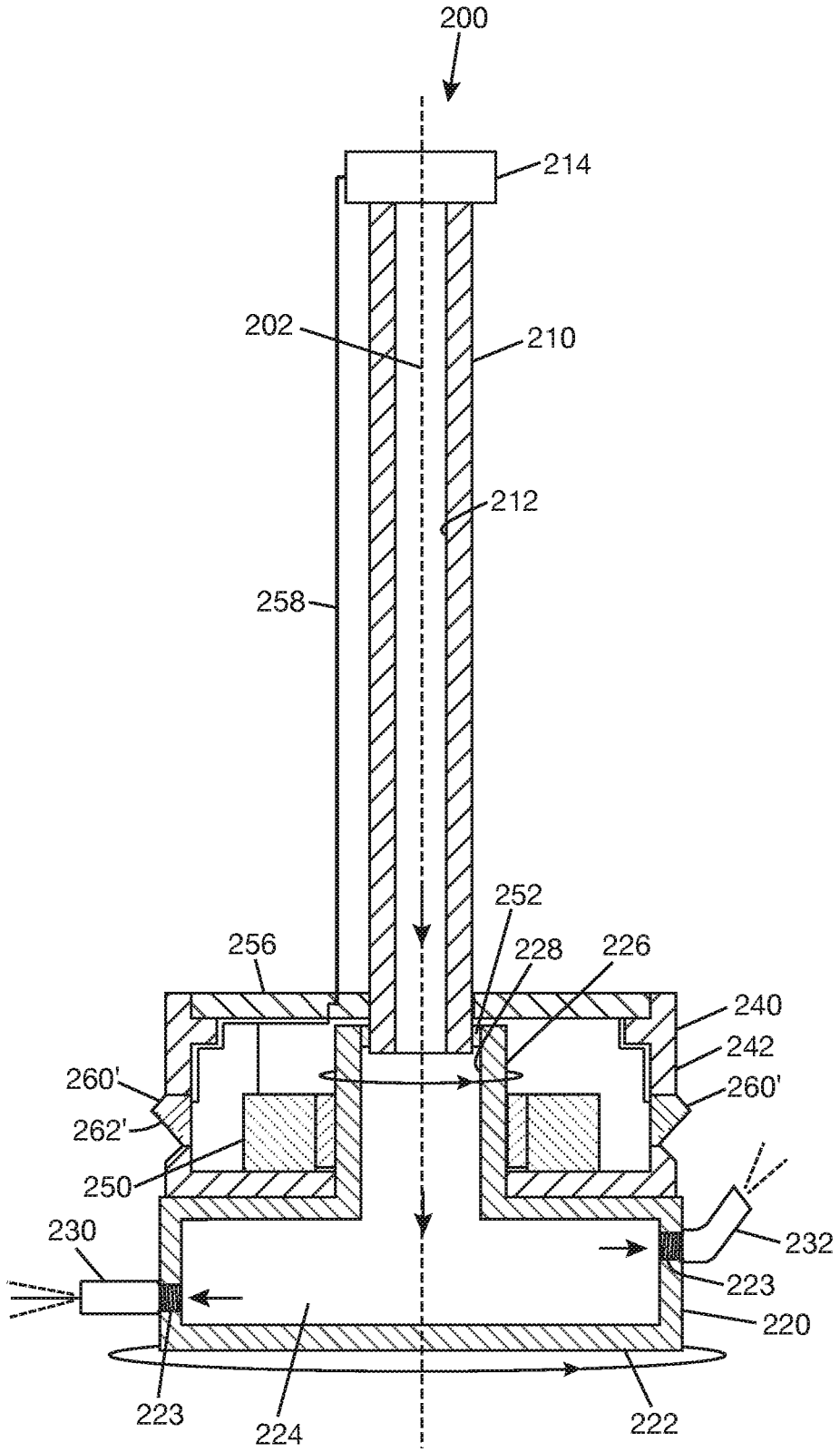
FIG. 6 is a vertical cross-section of the tool shown in FIG. 4 according to another implementation.

One or more proximity sensors 260 may be arranged on perimeter 246 of housing 242 for the purpose of sensing the distance between housing 242 and a surrounding element. In the illustrated example of FIG. 5, sensing faces 262 of proximity sensors 260 are generally parallel to tool axis 202 (or axial axis of housing 242). This means that the sensing directions of proximity sensors 260 are perpendicular to tool axis 202. In this case, each proximity sensor 260 will measure a distance between housing 242 and a portion of the formation that surrounds the respective sensing face 262. To allow continuous monitoring of etching of the formation at each position of tool 200 within a wellbore, at least some of the nozzles, for example, angled nozzles 232, should be arranged to etch the portion of the formation that will surround sensing faces 262 of proximity sensors 260. Alternatively, proximity sensors could be arranged such that the sensing directions of the proximity sensors are pointing towards a portion of the formation that will surround container 222. This is illustrated for proximity sensors 260' in FIG. 6. In FIG. 6, sensing faces 262' are inclined relative to tool axis 202 (or axial axis of housing 242).

Figure 7:
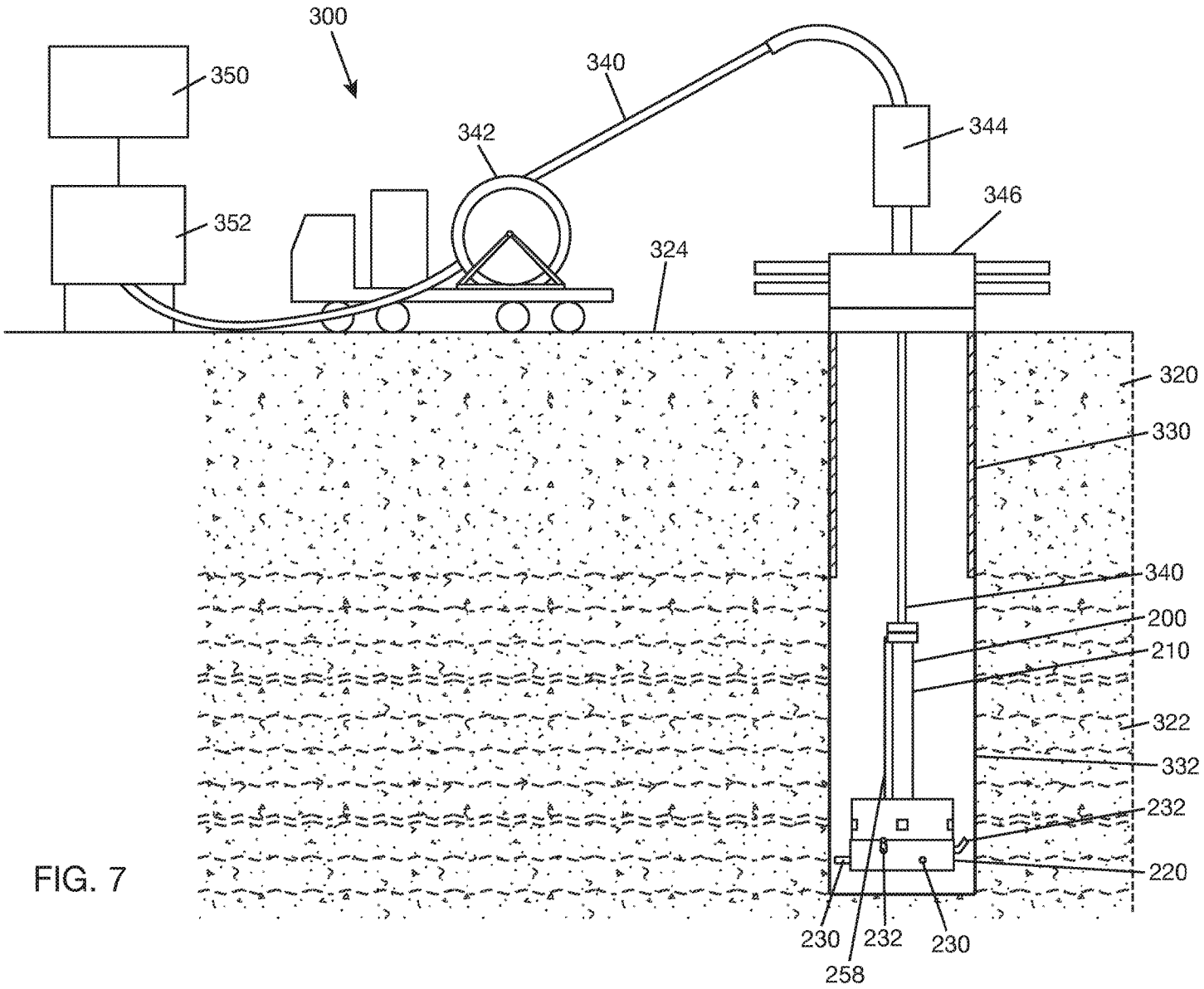
FIG. 7 is a schematic diagram of a system for forming a cavern for hydrocarbon production according to one implementation.

FIG. 7 shows a system 300 that can be used to form a cavern for hydrocarbon production. System 300 includes a wellbore 330 traversing subterranean formations 320, 322 below surface 324. For illustration purposes, formation 322 may be a hydrocarbon reservoir in which at least a portion of the cavern is to be formed. Wellbore 330 may be a vertical wellbore. System 300 includes tool 200 (from FIGS. 4-6) disposed in wellbore 330. Tool 200 is connected to an end of a coiled tubing 340 and is suspended in wellbore 330 by means of coiled tubing 340. Coiled tubing 340 is dispensed from a reel 342 at surface 324. Coiled tubing 340 may be guided into wellbore 330 through a tubing injector 344 and wellhead 346. In one example, coiled tubing 340 may be an electrical coiled tubing (also known as eCoil). In this case, coiled tubing 240 includes a conductor (not shown separately) to carry electrical power. The conductor may also carry communication signals. When coiled tubing 340 is connected to tool 200, an electrical connection is established between the conductor in coiled tubing 340 and cable 258 carried by tool 200. At the surface, the conductor in coiled tubing 340 may be connected to a power and communication module (not shown), allowing power to be delivered to components in tool 200 and communication with components in tool 200.

System 300 includes a tank 350 containing an aqueous solution that will be used to etch formation 322 in order to form the cavern. System 300 includes a pump 352 to pump the aqueous solution from tank 350 into coiled tubing 340. The aqueous solution pumped into coiled tubing 340 will flow into support tube 210 of tool 200 and into fluid dispenser 220 of tool 200, where the fluid can be jetted out through nozzles 230, 232 and directed towards the surrounding formation 322. The jet speed can be controlled by the pressure of the aqueous solution supplied into fluid dispenser 220.

Figure 8:
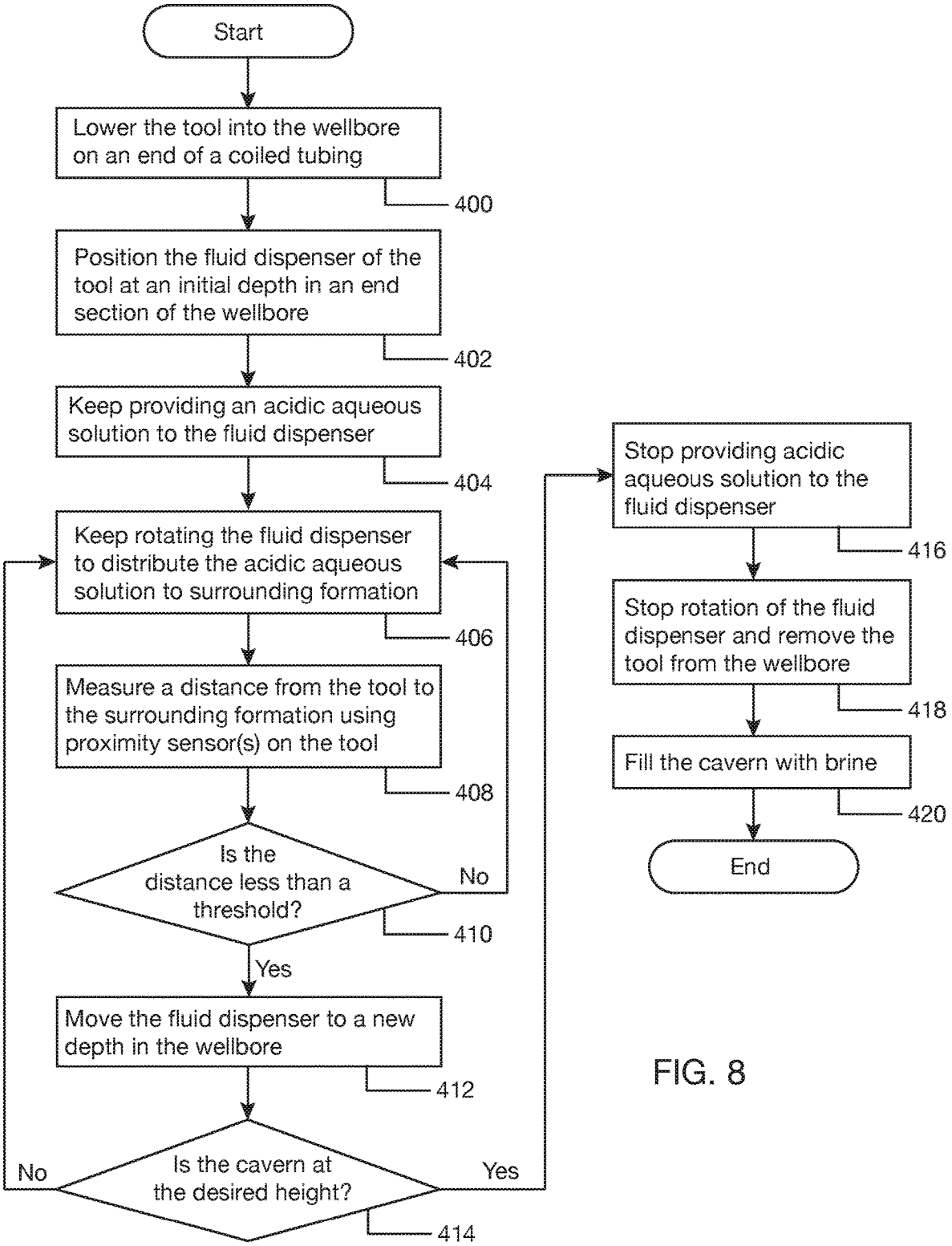
FIG. 8 is a flowchart illustrating a method of forming a cavern using the system of FIG. 7.

FIG. 8 is a flowchart showing a method of forming a cavern for hydrocarbon production using system 300 of FIG. 7. Referring to FIGS. 7 and 8, the method includes lowering tool 200 into wellbore 330 on an end of coiled tubing 340 (400 in FIG. 8). Tool 200 may be lowered into wellbore 330 by operating reel 342. The method includes positioning fluid dispenser 200 at an initial depth in end section 332 of wellbore 330 (402 in FIG. 8). In one implementation, this initial depth is at the bottom of wellbore 330. The method includes providing an acidic aqueous solution to fluid dispenser 220 (404 in FIG. 8). The acidic aqueous solution may be pumped from tank 350 into coiled tubing 340, which is fluidly connected to fluid dispenser 220. For etching of a carbonate formation, the acidic aqueous solution may be an aqueous solution of a mineral acid, such as hydrochloric acid, hydrofluoric acid, nitric acid, and phosphoric acid.

The method includes forming a cavern of a select height in end section 332 of wellbore 330. The cavern is formed in sections. To form a section of the cavern, the method includes rotating fluid dispenser 220 to distribute the acidic aqueous solution to a portion of formation 322 surrounding fluid dispenser 220 at the current depth of fluid dispenser 220 (406 in FIG. 8). Typically, rotation of fluid dispenser 220 is continuous. In some cases, rotation may be paused when moving the tool or when measuring a distance between the tool and the surrounding formation. The acidic aqueous solution is provided to fluid dispenser 220 (404 in FIG. 8) as fluid dispenser 220 is rotated so that there is a continuous supply of the acidic aqueous solution to be distributed to surrounding formation 322. The acidic aqueous solution in the internal chamber of fluid dispenser 220 exits through nozzles 230, 232 of fluid dispenser 220 in the form of jets (streams of fluid) that are directed towards surrounding formation 322. When the acidic aqueous solution contacts the formation, the acid will dissolve rock material in the formation, thereby etching (removing material from) the formation.

Figure 9:
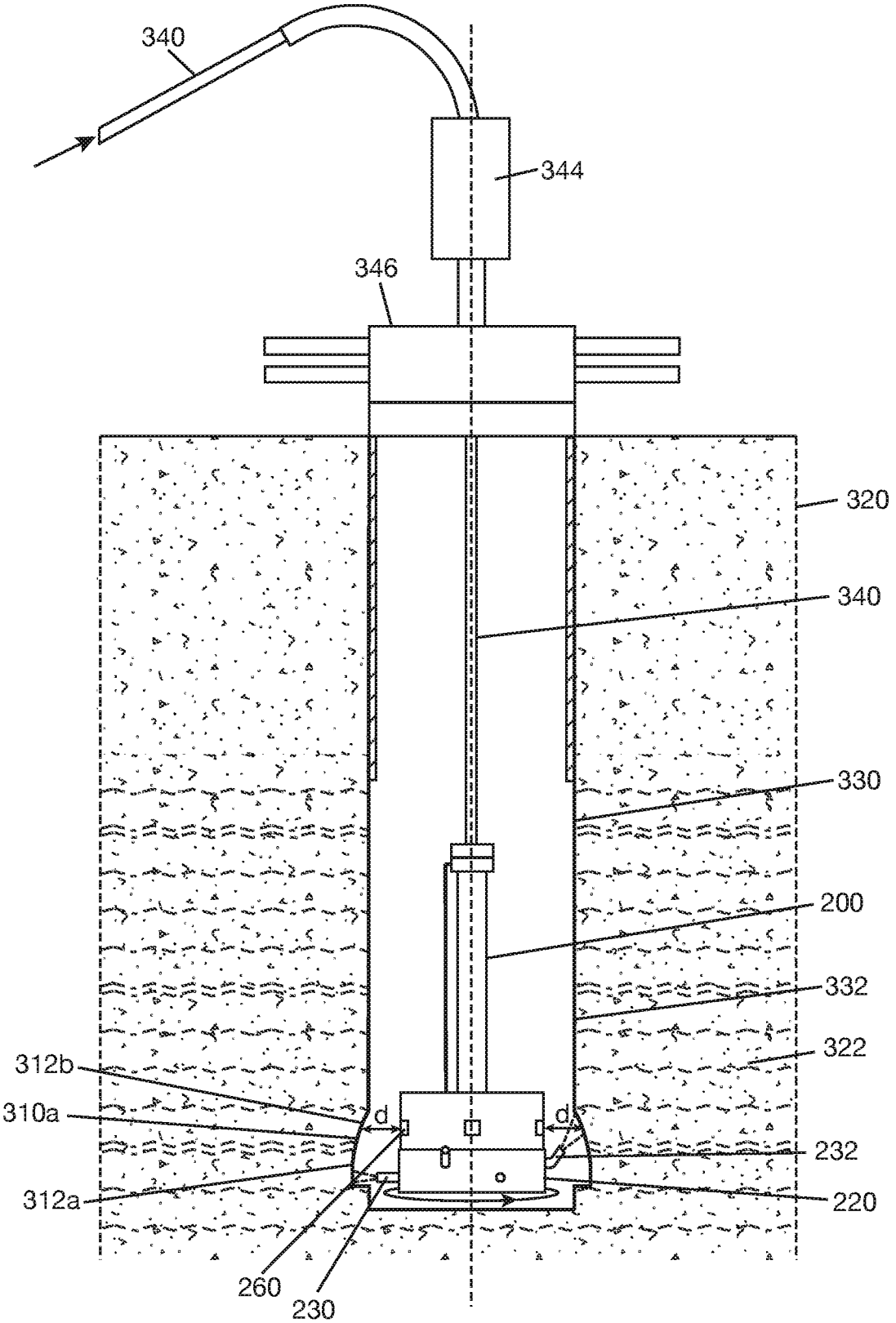
FIG. 9 is a schematic diagram showing a stage of forming a cavern according to the method of FIG. 8.

FIG. 9 shows a portion 310*a* of a cavern formed in end section 332 of wellbore 330. While forming the portion 310*a* of the cavern at the select depth, the method includes measuring the distance between tool 200 and the portion of formation 322 being etched using proximity sensors 260 carried by tool 200 (408 in FIG. 8). The method includes determining if the distance measured by the proximity sensor(s) is less than a threshold (410 in FIG. 8). If the distance is less than a threshold, the method continues with distributing acidic aqueous solution to the surrounding formation (406 in FIG. 8). If the measured distance between the proximity sensor(s) and the formation is at or greater than a threshold, the method includes moving the fluid dispenser to another depth in the wellbore (412 in FIG. 8). For illustrative purposes, FIG. 9 shows a distance d that is measured by a proximity sensor 260. Each of the proximity sensors 260 carried by tool 200 may measure some distance d between tool 200 and surrounding formation 322. In one example, a decision to adjust the position of fluid dispenser 200 (410 in FIG. 8) may be based on individual outputs of proximity sensors 260. For example, when all the proximity sensors 260 have reported a distance d that is at or above a predetermined threshold, a decision may be made to adjust the position of fluid dispenser 220 to the next depth. Alternatively, a decision to adjust the position of fluid dispenser 220 may be based on a combination of the outputs of the proximity sensors 260. For example, an average of the distances measured by proximity sensors 260 may be taken. If the average is equal to or above a predetermined threshold, a decision may be made to adjust the position of fluid dispenser 220.

Figure 10:
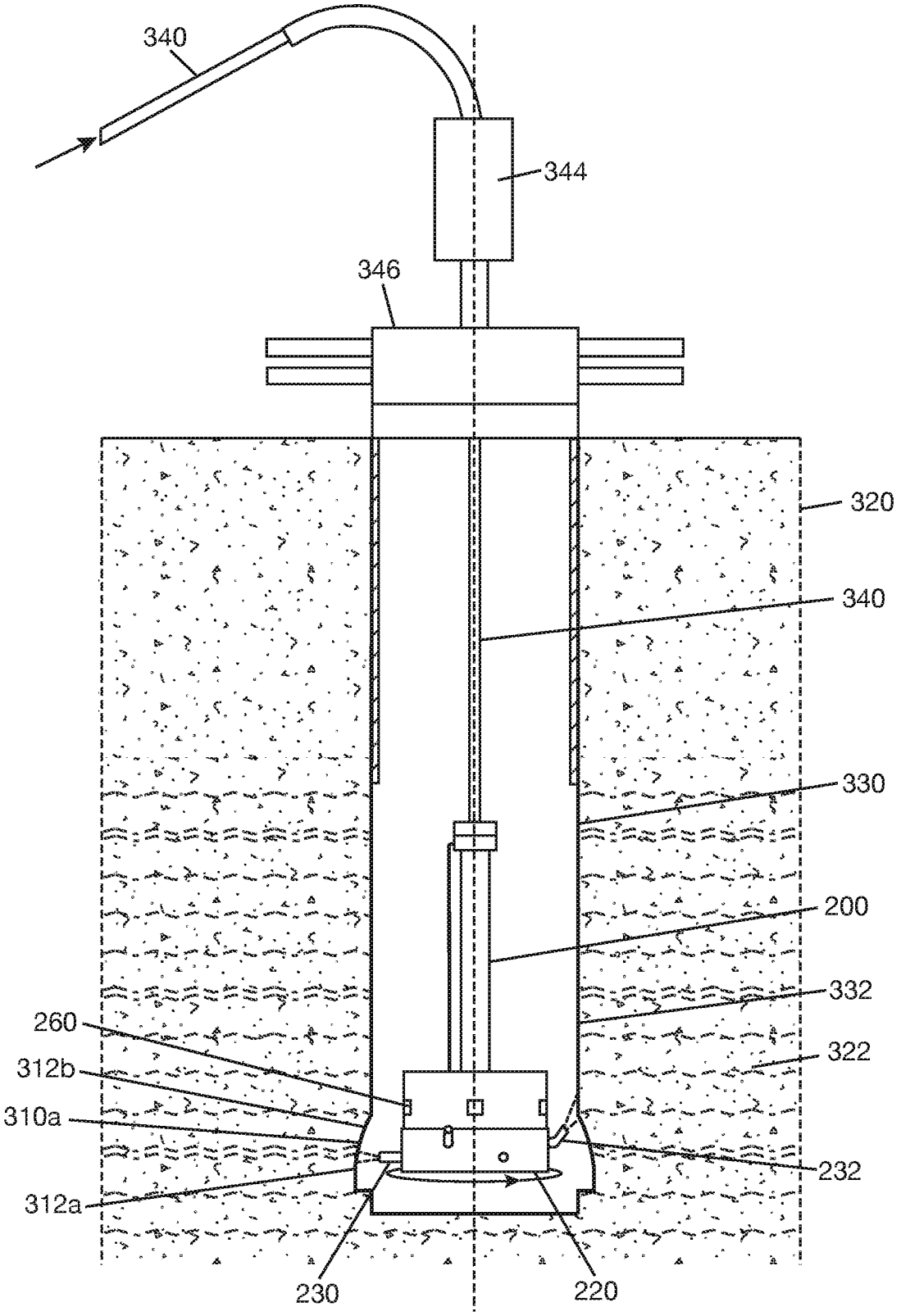
FIG. 10 is a schematic diagram showing another stage of forming a cavern according to the method in FIG. 8.

In the illustrated example, straight nozzles 230 form a cylindrical portion 312*a* of cavern portion 310*a*, and angled nozzles 232 form a dome shaped portion 312*b* of cavern portion 310*a*. Fluid dispenser 200 may be positioned at the next depth such that straight nozzles 230 will etch the dome shaped portion of a previous cavern portion, while angled nozzles 232 will form another dome shaped portion. This next position (from the position shown in FIG. 9) is illustrated in FIG. 10. At the new position, as fluid dispenser 200 is rotated, fluid dispenser 200 will distribute the acidic aqueous solution, resulting in etching of the surrounding formation 322. During this etching, the distance between tool 200 and the surrounding formation 322 will be measured to determine when to move fluid dispenser 200 to form another portion of the cavern. Typically, forming of the cavern starts at the bottom of wellbore 300, and each movement of tool 200 to a new depth involves raising tool 200, for example, by operating reel 342 (in FIG. 7) to pull up coiled tubing 340 (in FIG. 7).

Figure 11:
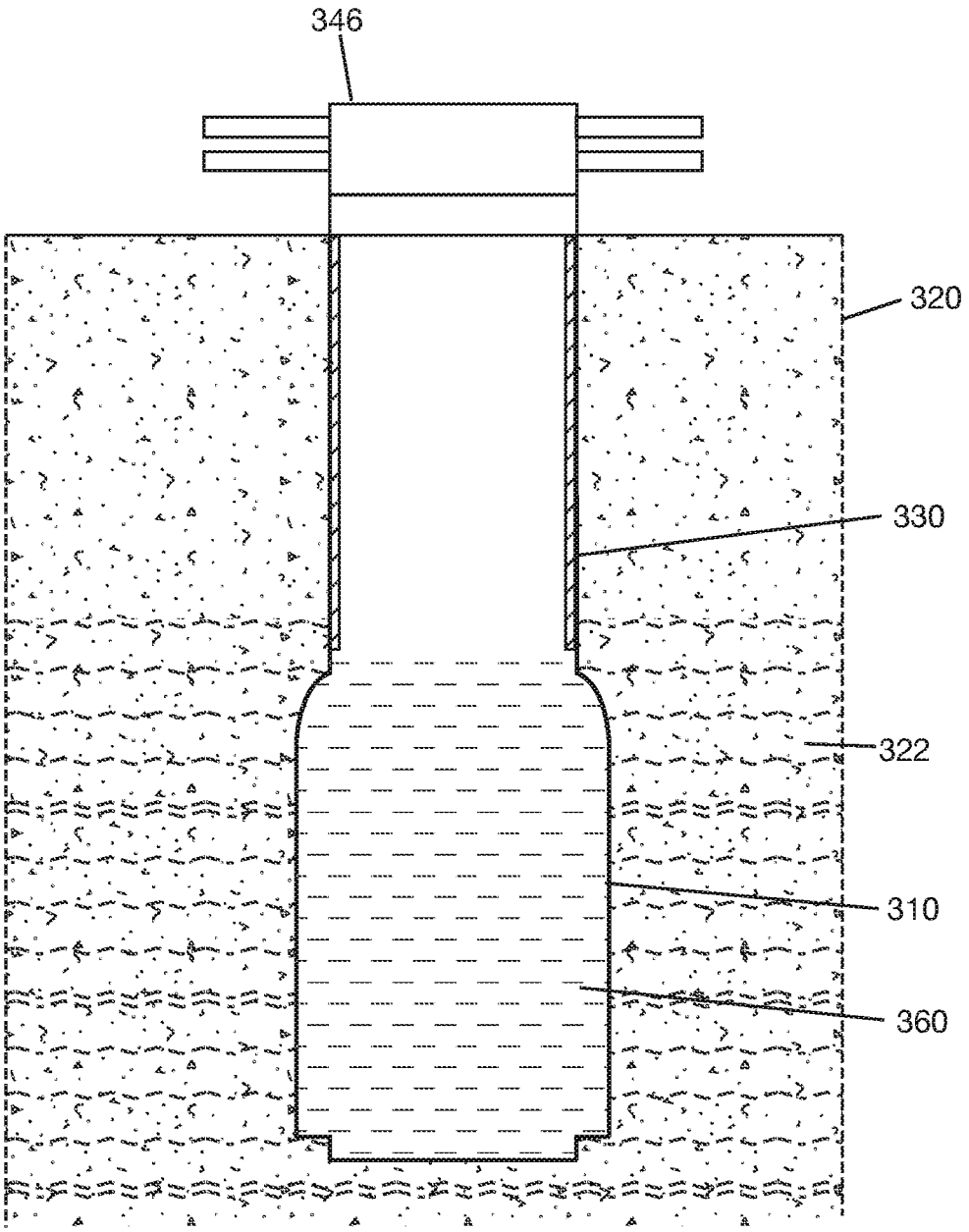
FIG. 11 is a schematic diagram showing a cavern formed according to the method in FIG. 8.

The method includes determining if the cavern has reached a desired height (414 in FIG. 8). The height of the cavern may be determined from the difference between the length of coiled tubing 340 disposed in wellbore 330 when fluid dispenser 220 is positioned at the initial depth and the length of coiled tubing 340 disposed in wellbore 330 at the current depth of fluid dispenser 220. If the cavern is not at the desired height, the process of forming a new portion of the cavern is carried out (406 to 412 in FIG. 8). If the cavern is at the desired height, the method includes stopping the flow of acidic aqueous solution to fluid dispenser 220 (416 in FIG. 8). The angled nozzles 232 will allow a final dome shape at the top of the cavern to be formed. Another method of forming a dome shape at the top of the cavern without use of angled nozzles 232 is to orient tool 200 at various angles when the cavern has reached the desired height in order to form the dome shape at the top of the cavern. Prior to stopping flow of acidic aqueous solution to fluid dispenser 220, if needed, a dome shape may be formed at the top of the cavern. After the desired height and shape of the cavern have been formed, the method includes stopping rotation of fluid dispenser 220 and removing tool 200 from wellbore 330 (418 in FIG. 8). The method includes filling the cavern with brine (420 in FIG. 8). FIG. 11 shows a cavern 310 of the desired height formed in the end section 332 of wellbore 330. Tool 200 has been pulled out of wellbore 330, and cavern 310 has been filled with brine 360. Although not shown, the portion of wellbore 330 above cavern 330 may be filled with brine as well. The method of forming a cavern as described with reference to FIGS. 7-11 can be used to form cavern 130 in FIGS. 1-3.

While the invention has been described with respect to a limited number of embodiments, those skilled in the art, having the benefit of this disclosure, will appreciate that other embodiments can be devised that do not depart from the scope of the invention as described herein. Accordingly, the scope of the invention should be limited only by the accompanying claims.

What is claimed is:

1. A method for hydrocarbon production, the method comprising:

forming a wellbore in a subterranean formation;

disposing a tool comprising a fluid dispenser and at least one proximity sensor in the wellbore;

positioning the fluid dispenser at an initial depth in an end section of the wellbore;

providing an acidic aqueous solution to the fluid dispenser; and forming a cavern of a select height in the end section of the wellbore with the tool, the forming comprising:

rotating the fluid dispenser to distribute the acidic aqueous solution to a portion of the subterranean formation surrounding the fluid dispenser, wherein the acidic aqueous solution dissolves a rock material in the portion of the subterranean formation;

measuring a distance between the tool and the portion of the subterranean formation surrounding the fluid dispenser using the at least one proximity sensor;

adjusting a position of the fluid dispenser to another depth in the end section of the wellbore if the distance measured is at or above a predetermined threshold; and removing the tool from the wellbore and filling the cavern with brine.

2. The method of claim 1, wherein disposing a tool having a fluid dispenser and at least one proximity sensor in the wellbore comprises lowering the tool into the wellbore on an end of a coiled tubing.

3. The method of claim 2, wherein providing an acidic aqueous solution to the fluid dispenser comprises providing the acidic aqueous solution through the coiled tubing.

4. The method of claim 1, wherein forming a wellbore in the subterranean formation comprises forming the wellbore in a carbonate formation comprising a hydrocarbon reservoir.

5. The method of claim 1, wherein positioning the fluid dispenser at an initial select depth in an end section of the wellbore comprises positioning the fluid dispenser proximate a bottom of the wellbore.

6. The method of claim 5, wherein adjusting a position of the fluid dispenser to another select depth in the end section of the wellbore comprises raising the fluid dispenser to the another select depth.

7. The method of claim 1, wherein the cavern formed has a cylindrical side wall and a dome shaped top wall.

8. The method of claim 1, further comprising disposing a production tubing in the wellbore and in fluid communication with the cavern.

9. The method of claim 8, further comprising withdrawing the brine from the cavern through the production tubing, wherein fluids from the subterranean formation flow into the cavern as the brine is withdrawn from the cavern.

10. The method of claim 9, wherein the fluids from the subterranean formation are stratified by gravity inside the cavern, and further comprising withdrawing the stratified fluids from the cavern through the production tubing.

11. The method of claim 10, wherein each of withdrawing the brine from the cavern through the production tubing and withdrawing the stratified fluids from the cavern through the production tubing comprises operating a pump disposed in the production tubing.

* * * * *